US009200386B2

(12) United States Patent
Chiang et al.

(10) Patent No.: US 9,200,386 B2
(45) **Date of Patent: *Dec. 1, 2015**

(54) ANTI-UV FIBER AND METHOD OF MANUFACTURING THEREOF

(71) Applicants: Kuo-Ching Chiang, New Taipei (TW); Mei-Ling Lo, New Taipei (TW)

(72) Inventors: Kuo-Ching Chiang, New Taipei (TW); Mei-Ling Lo, New Taipei (TW)

( * ) Notice: Subject to any disclaimer, the term of this patent is extended or adjusted under 35 U.S.C. 154(b) by 324 days.

This patent is subject to a terminal disclaimer.

(21) Appl. No.: 13/676,168

(22) Filed: Nov. 14, 2012

(65) Prior Publication Data

US 2013/0118634 A1 May 16, 2013

(30) Foreign Application Priority Data

| | | | |
|---|---|---|---|
| Nov. 15, 2011 | (TW) | ..... | 100141633 A |
| Nov. 15, 2011 | (TW) | ..... | 100141653 A |
| May 4, 2012 | (TW) | ..... | 101116071 A |
| Jun. 15, 2012 | (TW) | ..... | 101121694 A |

(51) Int. Cl.

| | |
|---|---|
| ***D06P 5/20*** | (2006.01) |
| ***D03D 49/20*** | (2006.01) |
| ***D03D 23/00*** | (2006.01) |
| ***D06M 11/46*** | (2006.01) |
| ***D01F 1/10*** | (2006.01) |

(52) U.S. Cl.
CPC ..... *D03D 23/00* (2013.01); *D01F 1/106* (2013.01); *D06M 11/46* (2013.01)

(58) Field of Classification Search
CPC ..... D03D 23/00; D06M 11/46; D01F 1/106
USPC ..... 8/506; 139/291 R
See application file for complete search history.

(56) References Cited

U.S. PATENT DOCUMENTS 5,153,066 A * 10/1992 Tanaka et al. ..... 428/373
5,821,287 A * 10/1998 Hu et al. ..... 524/89

* cited by examiner

*Primary Examiner* — Eisa Elhilo
(74) *Attorney, Agent, or Firm* — Chih Feng Yeh; Huntington IP Consulting Co., Ltd.

(57) ABSTRACT

A method of forming color change fiber, comprises preparing polymer base material and preparing color changeable material; mixing said polymer base material and said color changeable material with a weight percentage ratio; loading said mixed said polymer base material and said color changeable material into a melting apparatus; forming polymer fiber by spinning, weaving process, wherein said polymer fiber is color changeable when sunlight irradiates on said polymer fiber.

5 Claims, 2 Drawing Sheets

ANTI-UV FIBER AND METHOD OF MANUFACTURING THEREOF

CROSS-REFERENCE TO RELATED APPLICATION

This present application claims priority to TAIWAN Patent Applications: Serial No. 100141633 filed on Nov. 15, 2011, Serial No. 101116071 filed on May 4, 2012, Serial No. 100141653 filed on Nov. 15, 2012, and Serial No. 101121694 filed on Jun. 15, 2011, which are all herein incorporated by reference.

TECHNICAL FIELD

The present invention generally relates to anti-UV fiber and the method of manufacturing thereof.

DESCRIPTION OF THE RELATED ART

The current anti-UV cloth uses a material to coat on a cloth. The process requires an additional coating process and the coated material is likely to be removed from the cloth, thereby causing the anti-UV function failure.

SUMMARY

The present invention provides a method of forming color change lens, comprising preparing molding base material and preparing color changeable material; mixing said molding base material and said color changeable material with a weight percentage ratio; loading said mixed molding base material and said color changeable material into a molding apparatus; forming lens by molding process by said molding apparatus with a temperature, wherein said lens is color changeable when sunlight irradiates on said lens.

If the color changeable material includes photochromic or thermal-chromic dye, the molding process includes injection molding, extrusion molding and the molding temperature is below dissociation temperature of said photochromic or thermal-chromic dye, a molding temperature is about 180-200、200-220、220-230、230-250° C., and said molding base material is PC or PMMA.

If the color changeable material includes silver halide and copper oxide, the silver halide includes silver bromide, silver chloride or the combination. The molding process includes injection molding or extrusion molding. The molding temperature is about 180-200、200-220、220-230、230-250, 250-280, 280-300° C. The molding base material is PC or PMMA. If the color changeable material includes titanium dioxide doped with silver, the molding process includes injection molding or extrusion molding. The molding temperature is about 180-200、200-220、220-230、230-250, 250-280, 280-300° C.

A method of forming color change fiber, comprises preparing polymer base material and preparing color changeable material; mixing said polymer base material and said color changeable material with a weight percentage ratio; loading said mixed said polymer base material and said color changeable material into a melting apparatus; forming polymer fiber by spinning, weaving process, wherein said polymer fiber is color changeable when sunlight irradiates on said polymer fiber. The color changeable material includes photochromic or thermal-chromic dye wherein a melting temperature is below dissociation temperature of said photochromic or thermal-chromic dye. The melting temperature is about 180-200、200-220、220-230、230-250° C., 250-300° C.

The color changeable material includes silver halide and copper oxide, wherein said silver halide includes silver bromide, silver chloride or the combination. The melting temperature is about 180-200、200-220、220-230、230-250, 250-280, 280-300° C. The color changeable material includes titanium dioxide doped with silver, wherein a molding temperature is about 180-200、200-220、220-230、230-250, 250-280, 280-300° C.

DETAILED DESCRIPTION

Some sample embodiments of the invention will now be described in greater detail. Nevertheless, it should be recognized that the present invention can be practiced in a wide range of other embodiments besides those explicitly described, and the scope of the present invention is expressly not limited expect as specified in the accompanying claims. The following embodiment is just to illustrate rather than limiting the present invention.

Figure 1:
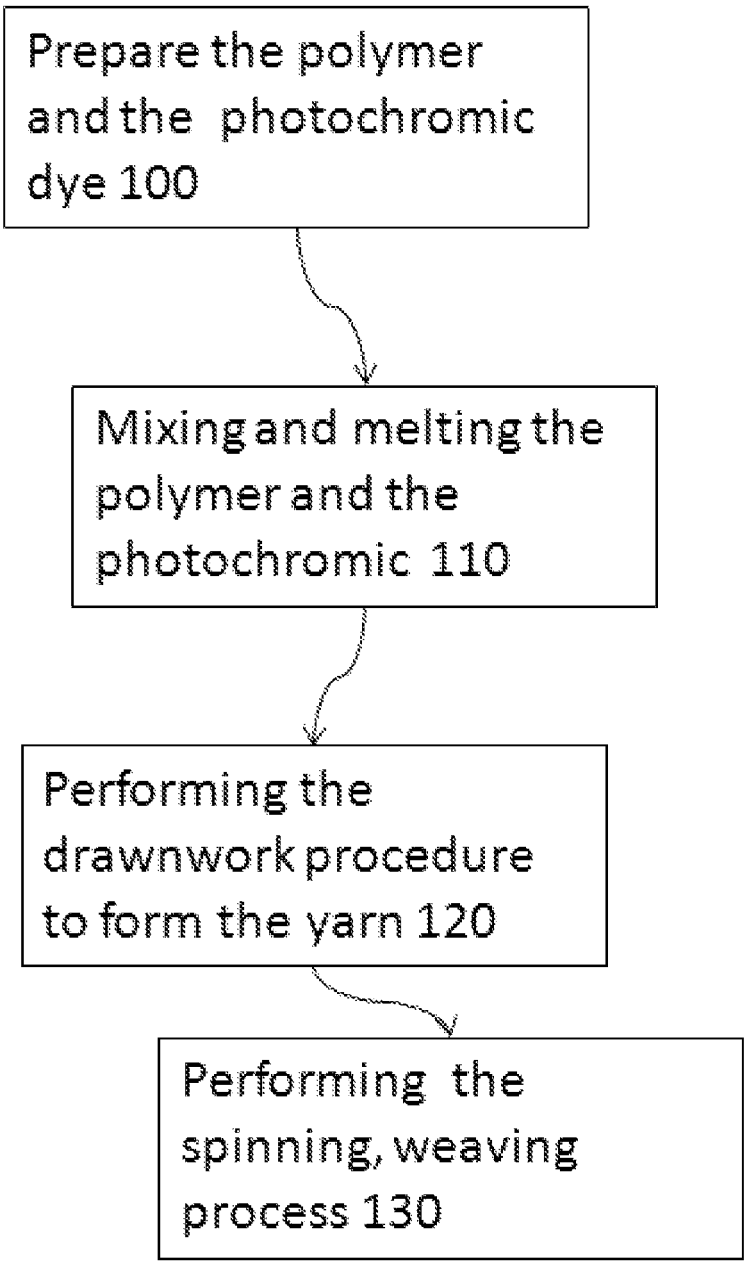
FIG. 1 shows the diagram of the present invention.

FIG. 1 shows the process of the present invention, the first step 100 is to prepare the fiber material and photochromic (or thermal-chromic) dye. The fiber is plastic fiber.

The photochromic (or thermal-chromic) dye is sensitive to the ultra-ray, when the photochromic dye is irradiated by the sunlight, the material will change it color due to the chemical structure is change. Therefore, the present invention will add the photochromic or thermal-chromic dye during the melting process to melt the polymer which is used to form the polymer fiber, and optionally, the stabilizers, UV absorbers or antioxidants may be added during the melting process. The photochromic dye may be spiropyrans、spiroxazines、fulgide、fulgimides、benzopyran、naphthopyran、spirobenzopyran、Spironaphthopyran、spirobenzoxazine or spironaphthoxazine.

The weight percentage of the photochromic dye is about 0.01%~0.3%. The process temperature during the melting is preferably under 260° C. to prevent the chemical structure of the photochromic dye from being dissociation. If the system uses the PMMA as the base material, the temperature of the injection is below 230° C., preferably, 180-200° C. If PC is the base material, the temperature of the injection is below 250° C., preferably, 220-245° C. Other material could be used, such as PET, Polyamide Fiber, Nylon 6, Nylon 6.6, Nylon1, Polyester Fiber, PBT, PTT, Polyacrylonitrile Fiber, Acrylic Fiber, Polyethylene Fiber, Polypropylene Fiber (PP), Polyvinylalcohol Fiber (PVA), Polyvinylchloride Fiber (PVC), Polytetrafluoroethylene Fiber (PTFE), Polyurethane Fiber, (PU), HMPE, PPS.

Please refer to FIG. 1, the polymer fiber material (base material) is mixed with the photochromic dye, and the temperature is raised to melting the polymer fiber material, and the photochromic dye is distributed evenly within the melted polymer, step 110. The next step is drawnwork procedure to form the yarn with the dye thereof, step 120. The next step is to perform the spinning, weaving process to allow the yarn to be the fiber, step 130. The fiber may be used to manufacture cloths, hat, sock, glove, pan, skirt, umbrella, which includes the photochromic dye to absorb the UV radiation and change the color to allow the user "see" the anti-UV effect. The temperature of the melting may be 180-200、200-220、220-230、230-250° C., 250-300° C. depending on the chosen polymer and the dyne. The base material should be dried with 1-5 hours depending on the quantity. Then, the dried based material is mixed with the photochromic dye by certain ratio. The ratio and the process temperature will affect the result of the color change. Further, the uppermost of the melting process temperature should be lower than the dissociation temperature of the dye. Further, the silver halide may be used alone or mixed with the photochromic dye to achieve the color change effect, in the embodiment, copper oxide maybe added during the process temperature is 220-250, 250-280° C. In another embodiment, titanium dioxide with silver may be used with the PMMA or PC to form the color change lens by the above injection or extrusion molding. The weight percentage is almost the same with the dye. The size of the particles may be 200-1000 nanometers. Nano-sized Ag deposits were formed on two commercial $TiO_2$ nanopowders. Under the sunlight the titanium dioxide with doped silver may change color due to the silver may catch or loss the electrons. The titanium dioxide with doped silver may be used to eliminate the bacteria on the lens, simultaneously. Preferably, the titanium dioxide may be formed on the lens surface by immersion on the solution of titanium dioxide with doped silver. Nano-sized Ag deposits were formed on two commercial $TiO_2$ nanopowders using a photochemical reduction method. The inactivation kinetics of $nAg/TiO_2$ was compared to the base $TiO_2$ material and silver ions leached from the catalyst. The increased production of hydroxyl free radicals is responsible for the enhanced viral inactivation. The doped silver $TiO_2$ material may have the color change effect as well.

Figure 2:
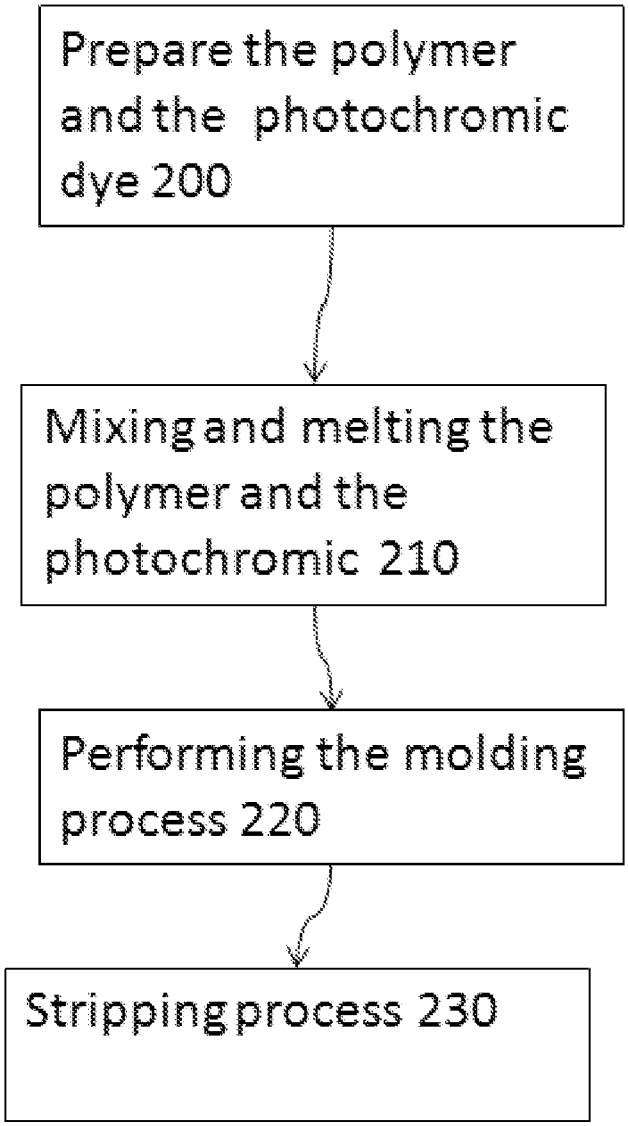
FIG. 2 shows the diagram of the present invention.

The method can be introduced into the manufacture of contact lens, please refer to FIG. 2. Please refer to FIG. 2, the polymer material (base material) is mixed with the photochromic dye 200, and the temperature is raised to melting the polymer material, and the photochromic dye is distributed evenly within the melted polymer, step 210. The next step is to perform the molding procedure to form the plastic contact lens by well-known procedure, step 220. The next step is to perform the stripping procedure to remove the molding devices to allow the lens be have the dyne contained therein, step 230. The contact lens includes the photochromic dye to absorb the UV radiation and change the color to allow the user "see" the anti-UV and fashion effect. The temperature of the melting may be 180-200、200-220、220-230、230-250° C., 250-300° C. depending on the chosen polymer and the dyne. The base material should be dried with 1-5 hours depending on the quantity. Then, the dried based material is mixed with the photochromic dye by certain ratio. The ratio and the process temperature will affect the result of the color change. Further, the uppermost of the molding process temperature should be lower than the dissociation temperature of the dye. Further, the silver halide may be used alone or mixed with the photochromic dye to achieve the color change effect, in the embodiment, copper oxide maybe added during the process temperature is 220-250, 250-280° C. In another embodiment, titanium dioxide with silver may be used with the PMMA or PC to form the color change lens by the above injection or extrusion molding. The weight percentage is almost the same with the dye. The size of the particles may be 200-1000 nanometers. Nano-sized Ag deposits were formed on two commercial $TiO_2$ nanopowders. Under the sunlight the titanium dioxide with doped silver may change color due to the silver may catch or loss the electrons. The titanium dioxide with doped silver may be used to eliminate the bacteria on the lens, simultaneously. Preferably, the titanium dioxide may be formed on the lens surface by immersion on the solution of titanium dioxide with doped silver. Nano-sized Ag deposits were formed on two commercial $TiO_2$ nanopowders using a photochemical reduction method. The inactivation kinetics of $nAg/TiO_2$ was compared to the base $TiO_2$ material and silver ions leached from the catalyst. The increased production of hydroxyl free radicals is responsible for the enhanced viral inactivation.

The IR causes the cornea, lens and vitreous humor damage, for example 0.8~1.2 micron-meter IR ray and 760~1400 nm IR ray is not good the eyes. The method can be introduced into the manufacture of contact lens with IR cut function if the anti-IR material is introduced into above embodiments alone or combination. The polymer material (base material) is mixed with the anti-IR material with size of about 80-350 nano-meter. The other procedure is similar with the above embodiments.

Aforementioned description is to illustrate purposes of the present invention, technical characteristics to achieve the purposes, and the advantages brought from the technical characteristics, and so on. And the present invention can be further understood by the following description of the preferred embodiment accompanying with the claim.

What is claimed is:

1. A method of forming anti-UV fiber, comprising preparing polymer base material and preparing anti-UV material;

mixing said polymer base material and said anti-UV material with a weight percentage ratio;

loading said mixed said polymer base material and said anti-UV material into a melting apparatus;

forming polymer fiber by spinning, weaving process, wherein said polymer fiber is anti-UV when sunlight irradiates on said polymer fiber, wherein said anti-UV material is selected from the group of silver halide, titanium dioxide doped with silver and the combination thereof.

2. The method according to claim 1, further comprising performing a drawnwork process before said spinning, weaving processes.

3. The method according to claim 1, a melting temperature is about 180-300° C.

4. The method according to claim 1, wherein said silver halide includes silver bromide, silver chloride or the combination.

5. The method according to claim 4, wherein a melting temperature is about 180-300° C.

* * * * *